United States Patent [19]

Hatakeyama

[11] Patent Number: 4,930,528

[45] Date of Patent: Jun. 5, 1990

[54] VANITY CASE

[75] Inventor: Yoshiharu Hatakeyama, Tokyo, Japan

[73] Assignee: Yoshida Industry Co., Ltd., Tokyo, Japan

[21] Appl. No.: 168,320

[22] Filed: Mar. 18, 1988

[51] Int. Cl.[5] ..... A45D 42/02

[52] U.S. Cl. ..... 132/301; 132/293; 220/263

[58] Field of Search ..... 132/293, 301, 294, 314, 132/315, 316; 220/281, 263, 264

[56] References Cited

U.S. PATENT DOCUMENTS

| | | | |
|---|---|---|---|
| 4,276,893 | 7/1981 | Enomoto et al. | 132/301 |
| 4,331,168 | 5/1982 | Hatakeyama | 132/316 |
| 4,366,829 | 1/1983 | Yuhara | 132/301 |
| 4,387,730 | 1/1983 | Shioi | 132/301 |
| 4,392,503 | 7/1983 | Watanabe | 132/301 |
| 4,399,826 | 8/1983 | Ogasawara | 132/301 |
| 4,474,196 | 10/1984 | Yuhara | 132/301 |
| 4,483,355 | 11/1984 | Yuhara | 132/301 |
| 4,580,586 | 4/1986 | Kitoh et al. | 132/315 |
| 4,595,028 | 6/1986 | Yuhara | 132/314 |
| 4,679,576 | 7/1987 | Yuhara et al. | 132/293 |
| 4,683,899 | 8/1987 | Yuhara et al. | 132/293 |
| 4,774,973 | 10/1988 | Gueret | 132/293 |
| 4,799,503 | 1/1989 | Tahara | 220/260 |

FOREIGN PATENT DOCUMENTS 61-154806 7/1986 Japan .

*Primary Examiner*—Gene Mancene
*Assistant Examiner*—Adriene J. Lepiane
*Attorney, Agent, or Firm*—Wenderoth, Lind & Ponack

[57] ABSTRACT

A vanity case includes a receptable and a cover hinged with each other at rear ends thereof, the cover being maintained in a closed position by engagement between latch tongues formed on the receptacle and the cover. The receptacle is formed at the front end with a recess within which is slidably disposed a push piece having a front wall and an arm member integrally formed with the front wall through a first flexible section. The arm member has a leveled V-shape including a lower half and an upper half extending in a reverse direction with respect to the lower half, the lower and upper halves being integrally jointed together at a second flexible section. The upper end of the arm is positioned closely adjacent the lower surface of the cover, and at least the upper half of the arm is arranged to, upon inward movement of the push piece, swing about the second flexible section whereby the upper end forces the cover in an upward direction to release the engagement of the latch tongues.

9 Claims, 4 Drawing Sheets

VANITY CASE

BACKGROUND OF THE INVENTION

1. Field of the Invention

The present invention relates to a vanity case for use with make-up or the like. More particularly, this invention relates to an improvement of a vanity case of a type in which a receptacle member and a cover member are hinged together at the rear ends thereof and are arranged to be latched by snap engagement between a first latch tongue of the cover and a second latch tongue formed on an inner wall defining a recess which is formed in the front end of the receptacle to receive a push piece. The push piece is movable in the recess and is adapted to, upon rearward movement thereof, produce a force which urges the cover upwardly so as to release the engagement of the latch tongues.

2. Description of the Prior Art

A vanity case of the type set forth above is disclosed in, for example, U.S. Pat. No. 4,276,893 wherein the push piece is molded of relatively hard plastic material and includes an inner end portion and an enlarged outer end portion to form an inclined surface therebetween, the surface being inclined upwardly toward the outer end and abutting a lower end of a nose having the first latch tongue and extending from the lower surface of the cover when the latter is in a closed position with respect to the receptacle. Thus, pressing the push piece inwardly causes the nose to slide on the inclined surface, thereby urging the nose upwardly to open the cover.

In the above vanity case, however, the force acting on the nose has a direction perpendicular to the inclined surface and therefore includes a component of force in a horizontal direction, which component tends to urge the nose toward the inner wall of the recess where the second latch tongue is formed. It thus will be understood that a user would have to press the push piece with a relatively large force in order to open the cover since the component in the horizontal direction tends to strengthen the engagement between the first and second latch tongues. This is not desirable in view of the nature of the vanity case.

Japanese Utility Model KOKAI No. 61-154806 discloses another vanity case with a push piece which has a front wall and a tilt arm formed integrally with the front wall through a flexible section. The tilt arm extends upwardly and inwardly to abut at its inner end against the inner wall of the recess, with its upper end being adjacent the lower end of the nose. Upon inward movement of the push piece, the inner end of the arm slides on the inner wall of the recess to further tilt the arm, so that the upper end of the arm forces the nose in upward and forward directions to thereby open the cover. Vanity cases with push pieces having similar arms are also disclosed in U.S. Pat. Nos. 4,679,576 and 4,683,899.

These push pieces with the arms may reduce the force required for releasing the engagement between the latch tongues, because the arm urges the cover not only in the upward direction but also in the forward direction in which the first latch tongue moves away from the second, latch tongue. After the release of engagement, the cover can be opened to any desired angle by a user's finger which is inserted into a space created between the cover and the receptacle. It is thus convenient that such a space be as large as possible. This space, i.e. a degree of initial opening of the cover, depends on the length of the arm. In the above vanity cases, however, to elongate the arm necessarily involves an increase of size of the push piece itself and of the recess, thus resulting in an increase of the size of the entire assembly. This is contrary to a recent development which requires that the vanity case be made thinner and smaller.

SUMMARY OF THE INVENTION

It is therefore an object of the present invention to provide a vanity case of the type set forth above in which a push piece causes release of engagement between latch tongues with a relatively small force, and in which a degree of initial opening of a cover member with respect to a receptacle member may be increased for facilitating a subsequent manual opening operation.

Another object of the present invention is to provide a vanity case the push piece of which may be a one-piece molded member to thereby permit the vanity case to be manufactured and assembled easily.

According to the present invention, a vanity case comprises a receptacle member for containing cosmetic material, a cover member hinged with the receptacle member at rear ends thereof, a recess formed in the front end of the receptacle member, first latch tongue formed on the cover member, and a second latch tongue formed on the receptacle member at a position within the recess, the first and second latch tongues being engaged with each other by snap action when the receptacle member is closed by the cover member to thereby maintain the cover member in a closed position with respect to the receptacle member. Disposed within the recess is a push piece which is movable therein backwardly and forwardly and which has a front wall and an arm member integrally formed with the front wall through a first flexible section, the arm member extending upwardly from the first flexible section toward the lower surface of the cover member. The arm member includes a lower half and an upper half extending in a reverse direction with respect to the lower half, the lower and upper halves being integrally joined together at a second flexible section. The upper end of the arm member is positioned closely adjacent the lower surface of the cover member, and at least the upper half is adapted to, upon inward movement of the push piece, swing about the second flexible section such that the upper end of the arm member forces the lower surface of the cover member in an upward direction to release engagement between the latch tongues.

In one embodiment of the invention, the lower half of the arm member extends from the first flexible section toward an inner wall of the respective member defining the recess and the upper half extends from the second flexible section toward the front wall of the push piece. The second flexible section may be in contact with the inner wall of the recess, and the inward movement of the push piece may cause the lower half to swing about the first flexible section to thereby raise the position of the second flexible section.

In another embodiment of the invention, the first flexible section is formed on a bottom wall of the push piece, and the lower half of the arm member extends from that section toward the front wall of the push piece while the upper half extends from the second flexible section toward the inner wall defining the recess. Preferably, the upper end of the arm member abuts against the lower surface of the cover member and normally urges the cover member upwardly when the cover member is in the closed position.

Other objects, features and advantages of the present invention will be apparent from the following detailed description of preferred embodiments thereof when taken in conjunction with the accompanying drawings.

DESCRIPTION OF PREFERRED EMBODIMENTS

Figure 1:
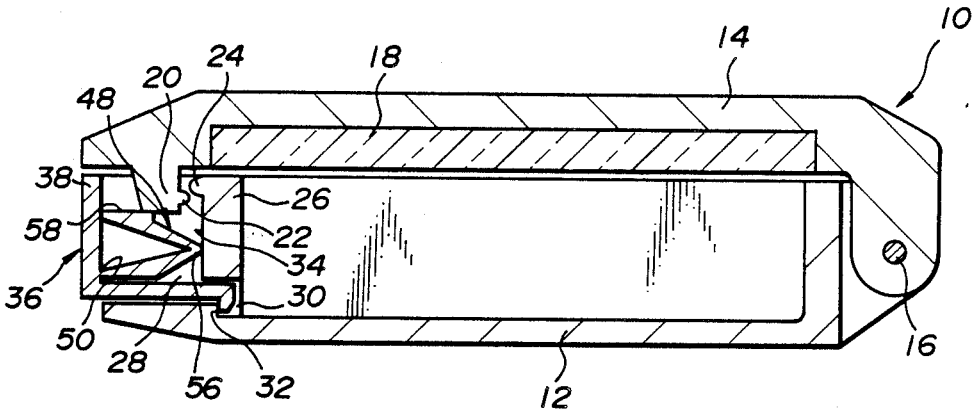
FIG. 1 is a sectional view showing a vanity case according to a first embodiment of the present invention.
Figure 2:
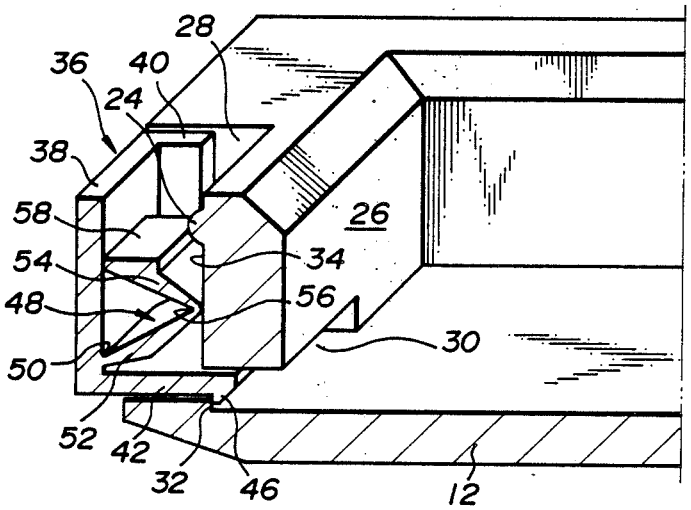
FIG. 2 is a fragmentary perspective view illustrating a recess and a push piece of the vanity case in FIG. 1.

Referring to FIGS. 1 to 6 of the drawings, there is illustrated a vanity case according to a first embodiment of the invention. The vanity case generally designated by numberal 10 includes a receptacle member 12 adapted to receive therein a cosmetic material or the like and molded of plastic material, and a cover member 14 also molded of plastic material and hinged with the receptacle 12 at respective rear ends through a pin 16. Attached to the inner surface of the cover 14 is a mirror 18 for convenience in make-up. A nose or projection 20 extends downwardly from the front end of the cover 14 and is provided with a first latch tongue 22 which projects rearwardly to engage with a second latch tongue 24 formed on an inner wall 26 of the receptacle 12. The inner wall 26 defines a box-like recess 28 formed in the central portion of the front end of receptacle 12 for permitting the nose 20 to extend therein. The cover 14 is maintained in a closed position with respect to the receptacle 12 by snap engagement between the first and second latch tongues 22 and 24. The inner wall 26 is drilled at its lower central portion to provide a guide hole 30 which is enlarged at an intermediate part thereof by a step 32 formed on the bottom surface of the receptacle 12. Between the guide hole 30 and the second latch tongue 24 the inner wall 26 provides a smooth vertical surface 34.

Figure 3:
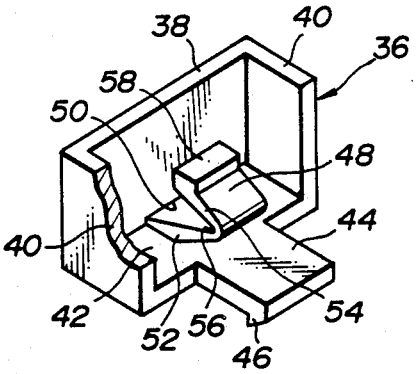
FIG. 3 is a partly broken away perspective view of the push piece in FIG. 2.

Disposed within the recess 28 is a push piece 36 adapted to function as a releasing member for the latch tongues 22 and 24. The push piece 36 is a one-piece member molded of plastic material and, as best shown in FIG. 3, includes a vertical front wall 38, a pair of side walls 40 extending rearwardly from the wall 38 at opposite sides thereof, and a bottom wall 42 extending between the side walls 40 and having a guide projection 44 which projects rearwardly to fit in the guide hole 30 in a slidable manner. A pawl 46 in formed on the lower surface of the projection 44 at the front end thereof to engage with the step 32 of the receptacle 12.

The push piece 36 further comprises an arm member 48 a lower end of which is integrally connected, through a first flexible section 50, to the inner surface of the wall 38 at a position near the bottom wall 44. The arm member 48 has a lower half 52 and an upper half 54, these halves being integrally connected to each other by a second flexible section 56. The lower half 52 extends inwardly and upwardly from the first flexible section 50 while the upper half 54 extends outwardly and upwardly from the second flexible section 56, so that the arm member 48 is in the form of a leveled V-shape with its open end toward the front wall 38. The first and second flexible sections 50 and 56 are adapted to permit the lower half 52 and the upper half 54 to swing thereabout, respectively. The second section 56 is in contact with the surface 34 of the inner wall 26, while the upper edge of the arm member 48 is closely adjacent, or substantially abuts, the front wall 38. The upper end of the arm 48 is enlarged to provide a flat upper surface 58 which is closely adjacent, or substantially abuts, the lower end of the nose 20 when the cover 14 is in the closed position, as seen from FIGS. 1 and 4.

Figure 6:
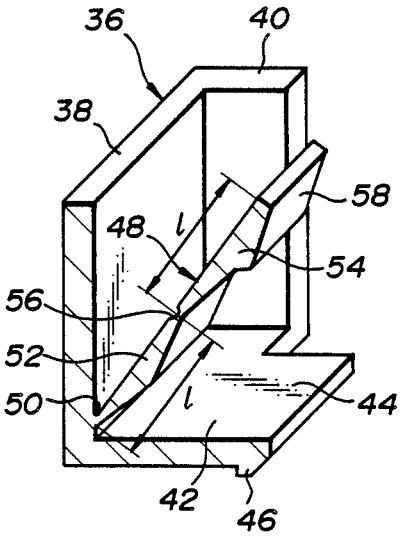
FIG. 6 is an enlarged perspective view in section of the push piece before folding an arm member thereof.

The push piece 36 may be molded of plastic material having elasticity and preferred examples thereof include polypropylene, high-density polyethylene, polybutylene terephthalate, polyethylene terephthalate and polyoxymethylene. Perferably, the push piece 36 is initially formed into a shape as illustrated in FIG. 6 in which the arm member 48 extends linearly, this remarkably reducing difficulty in design of molding dies. Thereafter, the arm 48 is folded at the second flexible section 56 and maintains the leveled V-shaped. In FIG. 6, each of the lower and upper halves 52, 54 is illustrated as having a length "l" so that the total length of the arm is 2 l.

Figure 4:
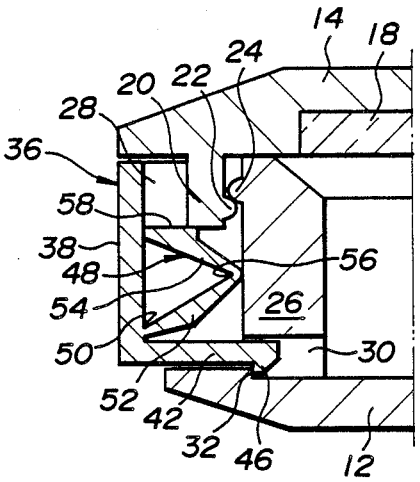
FIG. 4 is an enlarged sectional view of the vanity case in FIG. 1, with the push piece being in a normal position.
Figure 5:
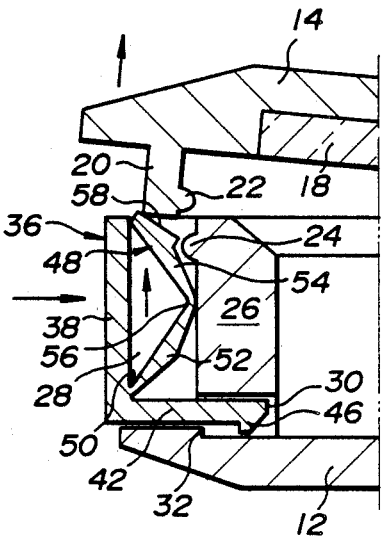
FIG. 5 is also an enlarged sectional view of the vanity case showing the push piece in an active position.

Assuming now that the cover 14 is closed over the receptacle 12 as shown in FIG. 4, when the vertical wall 38 is forced to move the push piece 36 inwardly, the arm member 48, movement of which is the same direction is restrained due to the contact of its section 56 with the vertical surface 34, is expanded or extended upwardly with the section 56 sliding on the surface 34 and the upper edge sliding on the front wall 38. That is, the lower half 52 swings about the first section 50 toward the front wall 38 while the upper half 54 swings about the second section 56 toward the inner wall 26 of the recess 28. These combined swing movements of the arm member 48 result in its upper surface 58 being elevated substantially uprightly and causes the surface 58 to press the nose 20 upwardly. Therefore, the first latch tongue 22 of the cover 14 is disengaged from the second latch tongue 24 of the receptacle 12 as shown in FIG. 5. It is to be noted here that no inwardly directed pressure is applied to the nose 20, which ensures that the engagement can be released with relatively small force.

A continuous pressure to the front wall 38 moves the push piece further inwardly while expanding the arm member 48 to a large extent. As the angle defined between the inner surfaces of the lower and upper halves 52, 54 nears 180 degrees, the length of arm member 48 approximates the 2 l. Thus, the arm member 48 lifts up the nose 20 away from the receptacle 12 so that a large space is provided between the front ends of the cover 14 and receptacle 12, facilitating the subsequent manual opening operation of the cover 14. It is important that this can be achieved without enlarging the push piece 36 and the recess 28.

The push piece 36 is a one-piece molded member as mentioned above and may be formed by injection molding using a simple die to reduce manufacturing costs. Also, assembly can be carried out easily by mounting the single piece 36 in the recess 28.

In the above embodiment the arm 48, upon inward movement of the push piece 36, acts on the nose 20 of the cover 14. It is possible within the present invention to have the arm member act on the lower surface of other portions of the cover 14.

Figure 7:
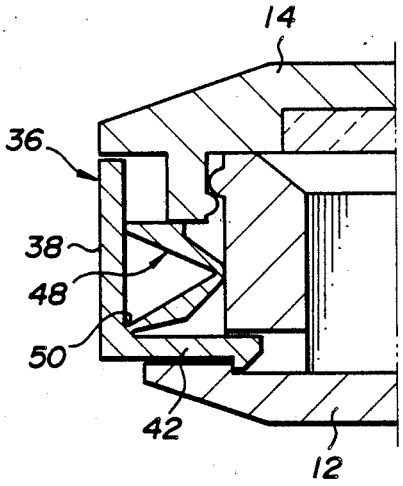
FIGS. 7 and 8 are fragmentary sectional views of vanity cases incorporating push pieces of slightly modified forms, respectively.
Figure 8:
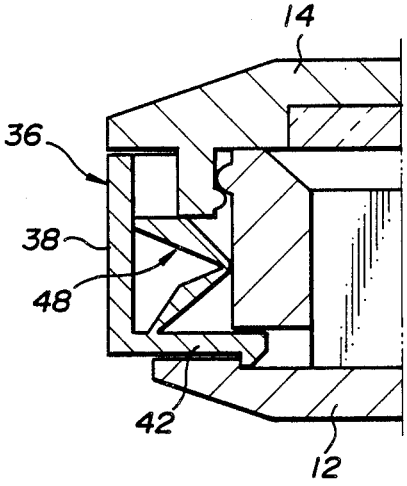
Figure 9:
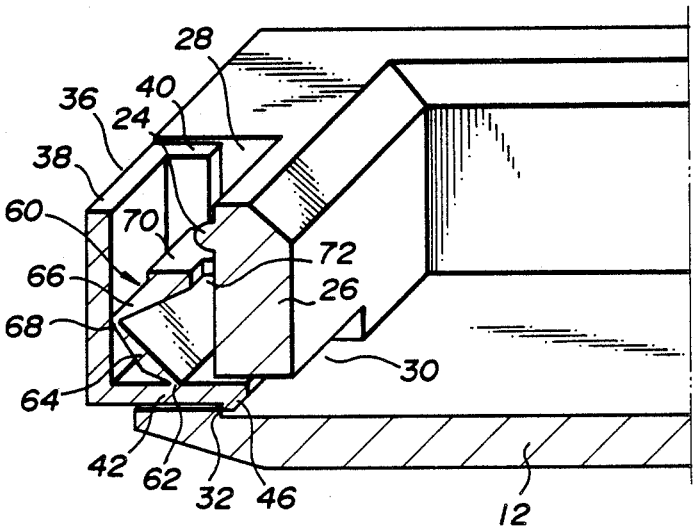
FIG. 9 is a fragmentary perspective view illustrating a recess and a push piece according to another embodiment of the invention.

FIGS. 7 and 8 illustrate slightly modified forms of the push piece 36. In the modification of FIG. 7 the lower end of the arm 48 is connected through the first flexible section 50 to a corner defined by the front wall 38 and the bottom wall 42, while the arm 48 in FIG. 8 extends from the bottom wall 42.

Another embodiment of the vanity case is illustrated in FIGS. 9 through 12 in which the same or corresponding parts as in the above embodiment are indicated by the same reference numerals. In this vanity case, the push piece 36 has an arm member 60 which is integrally connected through a first flexible section 62 to the bottom wall 42 and which comprises a lower half 64 and an upper half 66, these halves being joined together at a second flexible section 68 that is in contact with the front wall 38. The lower half 64 extends upwardly from the first section 62 toward the front wall 38 while the upper half 66 extends upwardly from the second section 68 toward the inner wall 26 of the recess 28. Thus this arm member 60 has a leveled V-shape with its open end toward the inner wall 26. The upper end of the arm 60 is enlarged to provide an upper surface 70 and is recessed as at 72 in order to prevent the second latch tongue 24 from interfering with a movement of the arm 60.

Figure 10:
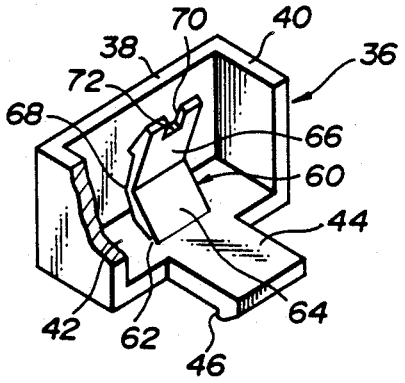
FIG. 10 is a partly broken away perspective view of the push piece in FIG. 9.
Figure 11:
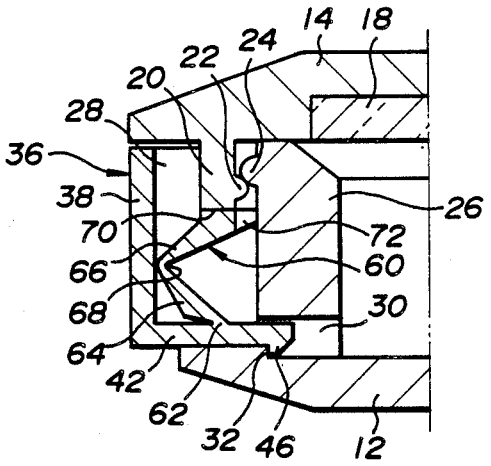
FIG. 11 is a fragmentary sectional view showing the vanity case of FIG. 9, with the push piece being in a normal position.

Preferably, the push piece 36 is formed into a shape shown in FIG. 10 wherein the upper half 66 of the arm 60 is raised relative to the lower half 64 with defining a relatively large angle therebetween, and in which the upper surface 70 is inclined with respect to the bottom wall 42. This shape is substantially maintained after the push piece is mounted in the recess 28 by inserting the projection 44 into the enlarged area of the guide hole 30. When the cover 14 is closed over the receptacle 12, the nose 20 first abuts the upper edge of the arm 60 and then presses down such upper edge. This causes the upper half 66 to swing downwardly about the second flexible section 68, with its inner edge sliding on the inner wall 26 until the first latch tongue 22 is engaged with the second latch tongue 24. As a result, the push piece 36 is moved forwardly or outwardly and its pawl 46 engages with the step 32 of the receptacle 12 as shown in FIG. 11. The upper surface 70 at that time extends in a horizontal direction to abut against the lower end of the nose 20. It will be thus understood that the nose 20 is urged upwardly by a resilient force that is generated in the second flexible section 68.

Figure 12:
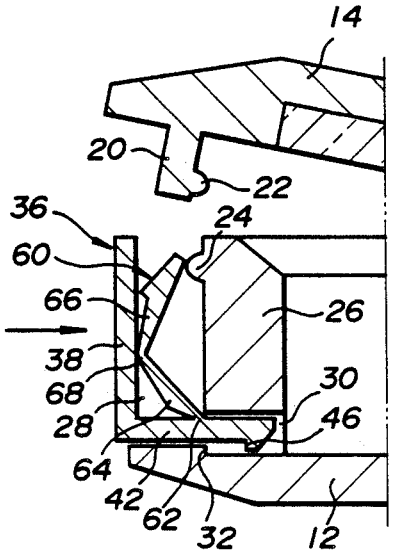
FIG. 12 is a view similar to FIG. 11 but with the push piece shown in an active position.

In the closed status of FIG. 11, when the front wall 38 is pressed to move the push piece 36 inwardly, the second flexible section 68 abutting the front wall 38 is also pressed inwardly. However, since the inward movement of the upper half 66 is restrained by the inner wall 26, and since the nose 20 prevents the upper end of the arm 60 from moving upwardly, stresses are applied to the flexible sections 62 and 68 whereby the resilient force thereof is increased. Immediately after the resilient force becomes sufficiently large to overcome the engagement between the latch tongues 22 and 24, the upper half 66 of arm 60 swings about the section 68 to raise the nose 20 and to open the cover 14. At this time the resilient force is released instantaneously, causing the cover 14 to open to a large angle as shown in FIG. 12.

In the illustrated example the upwardly directed force is applied to the nose 20 by the upper half 66 whenever the cover 14 is in the closed position. If desired, however, the arm member 60 may originally be formed into the shape of FIGS. 9 and 11. An initial pressure to the front wall 38 will generate a resilient force in the flexible sections 62, 68.

Although the present invention has been described with reference to the preferred embodiments thereof, many modifications and alterations may be made within the spirit of the invention.

What is claimed is:

1. A vanity case comprising:

a receptacle member for containing cosmetic material;

a cover member hinged with said receptacle member at respective rear ends thereof;

a recess formed in the front end of said receptacle member;

a first latch tongue formed on said cover member;

a second latch tongue formed on said receptacle member at a position within said recess;

said first and second latch tongues being engaged with each other by snap action when said cover member is closed over said receptacle member, thereby maintaining said cover member in a closed position with respect to said receptacle member; and a push piece disposed within said recess and being movable therein backwardly and forwardly, said push piece having a front wall and an arm member integrally formed with said front wall through a first flexible section, said arm member extending upwardly from said first flexible section toward the lower surface of said cover member and including a lower half and an upper half extending in a reverse direction with respect to said lower half, said lower and upper halves being integrally joined together at a second flexible section, said lower half extending from said first flexible section toward an inner wall defining said recess and said upper half extending from said second flexible section toward said front wall of said push piece, the upper end of said arm member being positioned closely adjacent said lower surface of said cover member in said closed position of said cover member, said second flexible section being in contact with said inner wall of said recess, and inward movement of said push piece causing said lower half to swing about said first flexible section to thereby raise the position of said second flexible section while causing said upper half to swing about said second flexible section, whereby said upper end of said arm member forces said lower surface of said cover member in an upward direction to release engagement between said first and second latch tongues.

2. A vanity case as claimed in claim 1, wherein said first flexible section is formed on the lower portion of said front wall.

3. A vanity case as claimed in claim 1, wherein said push piece further includes a bottom wall extending inwardly from the lower end of said front wall.

4. A vanity case as claimed in claim 3, wherein said first flexible section is formed on a corner defined between said front wall and said bottom wall.

5. A vanity case as claimed in claim 3, wherein said first flexible section is formed on said bottom wall.

6. A vanity case as claimed in claim 3, further comprising a guide hole formed through said inner wall defining said recess and a step formed on the bottom surface of said receptacle member to enlarge said guide hole.

7. A vanity case as claimed in claim 6, wherein said bottom wall of said push piece includes a projection adapted to slidably fit into said guide hole and a pawl engageable with said step for maintaining said push piece in said recess.

8. A vanity case as claimed in claim 1, wherein said lower surface of said cover member includes a projection on which is formed said first latch tongue, said upper end of said arm being closely adjacent the lower end of said projection in said closed position of said cover member.

9. A vanity case as claimed in claim 8, wherein said upper end of said arm member is enlarged to provide a flat upper surface.

* * * * *